US008979332B2

(12) United States Patent
Liu

(10) Patent No.: US 8,979,332 B2
(45) Date of Patent: Mar. 17, 2015

(54) MOUNTING DEVICE FOR LED LAMP

(75) Inventor: Chia-Fu Liu, Xinbei (TW)

(73) Assignee: Keeper Technology Co., Ltd., Xinbei (TW)

( * ) Notice: Subject to any disclaimer, the term of this patent is extended or adjusted under 35 U.S.C. 154(b) by 1114 days.

(21) Appl. No.: 12/979,422

(22) Filed: Dec. 28, 2010

(65) Prior Publication Data

US 2012/0163005 A1 Jun. 28, 2012

(51) Int. Cl.

| | |
|---|---|
| ***F21V 21/26*** | (2006.01) |
| ***F21S 4/00*** | (2006.01) |
| ***F21V 21/30*** | (2006.01) |
| *F21W 131/406* | (2006.01) |
| *F21Y 101/02* | (2006.01) |

(52) U.S. Cl.

CPC ..... *F21S 4/008* (2013.01); *F21V 21/30* (2013.01); *F21W 2131/406* (2013.01); *F21Y 2101/02* (2013.01)

USPC ..... 362/427; 362/418; 362/365; 362/366; 362/371

(58) Field of Classification Search

CPC ..... F21V 21/26; F21V 21/30; F21V 21/04; F21V 21/08; F21V 21/088; B60Q 1/124; F21W 2131/10; F21S 8/02; F21S 8/026; F21S 4/001

USPC ..... 362/427, 418, 365, 366, 371

See application file for complete search history.

(56) References Cited

U.S. PATENT DOCUMENTS

| | | | | |
|---|---|---|---|---|
| 3,754,136 | A * | 8/1973 | Osteen | 362/368 |
| 5,361,195 | A * | 11/1994 | Chen | 362/397 |
| 5,832,164 | A * | 11/1998 | Miekis | 385/136 |
| 7,959,334 | B2 * | 6/2011 | Tsai et al. | 362/396 |
| 8,240,867 | B2 * | 8/2012 | Wang | 362/101 |

* cited by examiner

*Primary Examiner* — Jong-Suk (James) Lee
*Assistant Examiner* — Mark Tsidulko
(74) *Attorney, Agent, or Firm* — Fishman & Associates, LLC.

(57) ABSTRACT

A mounting device for an LED lamp has a support tube and at least one fixed unit. The support tube has an outer surface and an external engaging surface. The external engaging surface is formed on the outer surface of the support tube. Each one of the at least one fixed unit has a positioning block mounted movably and pivotally around the support tube and has a front surface and an internal engaging surface. The internal engaging surface is formed on the front surface of the positioning block and engages the external engaging surface of the support tube. Therefore, it is convenient to adjust the fixed unit to a suitable position so that the LED lamp can be installed at any location.

4 Claims, 5 Drawing Sheets

MOUNTING DEVICE FOR LED LAMP

BACKGROUND OF THE INVENTION

1. Field of the Invention

The present invention relates to a mounting device for an LED lamp, and more particularly to an adjustable mounting device that is applicable to all installation locations.

2. Description of the Prior Arts

LED lamps use light-emitting diodes (LEDs) as sources of light. As diode technology has improved, LEDs with higher lumen output and lower power consumption make replacing incandescent bulbs in lamps possible.

With reference to FIG. 5, a conventional mounting device for an LED lamp comprises two stands 60. The stands 60 are attached to two opposite sides of the LED lamp 70 and each stand 60 has a connecting panel 61 and a positioning panel 62. The connecting panel 61 is mounted on the side of the LED lamp 70. The positioning panel 62 protrudes from a bottom edge of the connecting panel 61 and has multiple holes 621. Fasteners are mounted through the holes 621 of the positioning panels 61 to mount the LED lamp 70 on an installation location securely.

However, a distance between the stands 60 that are mounted securely on the LED lamp 70 is unchangeable, so the LED lamp 70 can only be mounted on specific installation locations with the fixed distance. When a user wants to change the installation location, the conventional mounting device may be inapplicable and another mounting device is required. Therefore, changing an LED lamp is inconvenient and costly.

To overcome the shortcomings, the present invention provides a mounting device for an LED lamp to mitigate or obviate the aforementioned problems.

SUMMARY OF THE INVENTION

The main object of the present invention is to provide a mounting device for an LED lamp that is applicable to all installation locations.

A mounting device for an LED lamp in accordance with the present invention comprises a support tube and at least one fixed unit. The support tube has an outer surface and an external engaging surface. The external engaging surface is formed on the outer surface of the support tube. Each one of the at least one fixed unit has a positioning block mounted movably and pivotally around the support tube and has a front surface and an internal engaging surface. The internal engaging surface is formed on the front surface of the positioning block and engages the external engaging surface of the support tube. Therefore, it is convenient to adjust the fixed unit to a suitable position so that the LED lamp can be installed at any location.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
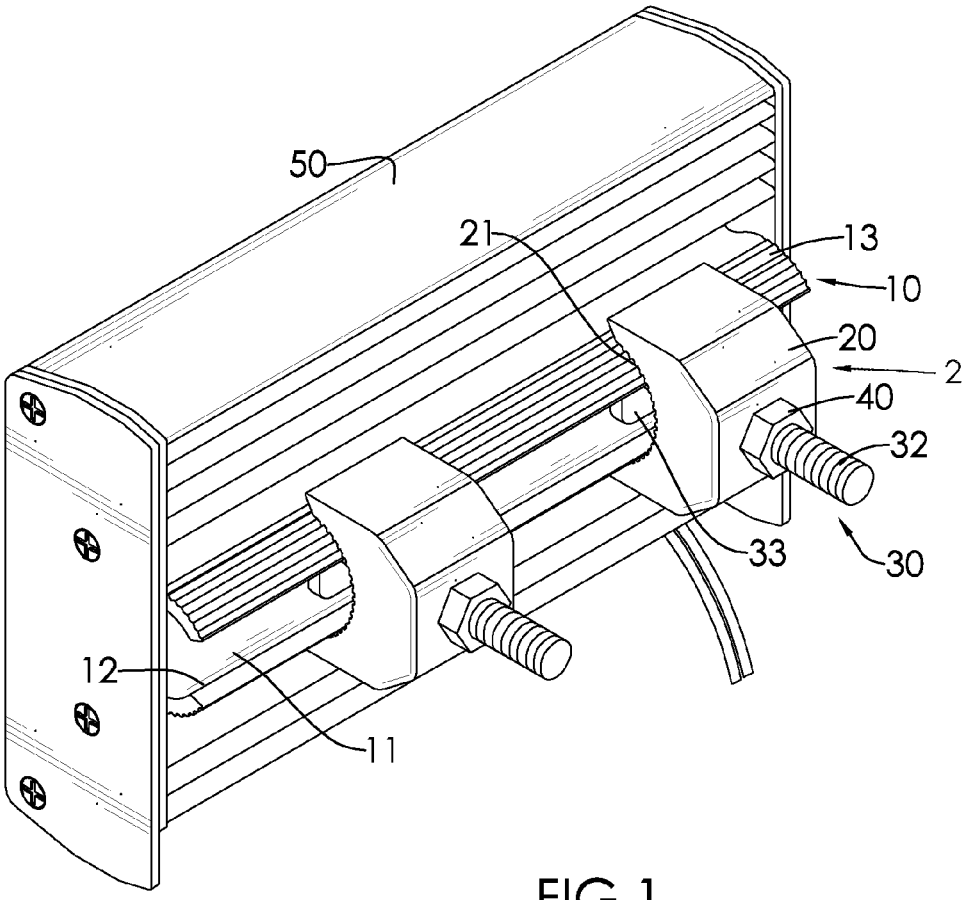
FIG. 1 is a perspective view of an LED lamp with a mounting device in accordance with the present invention.
Figure 2:
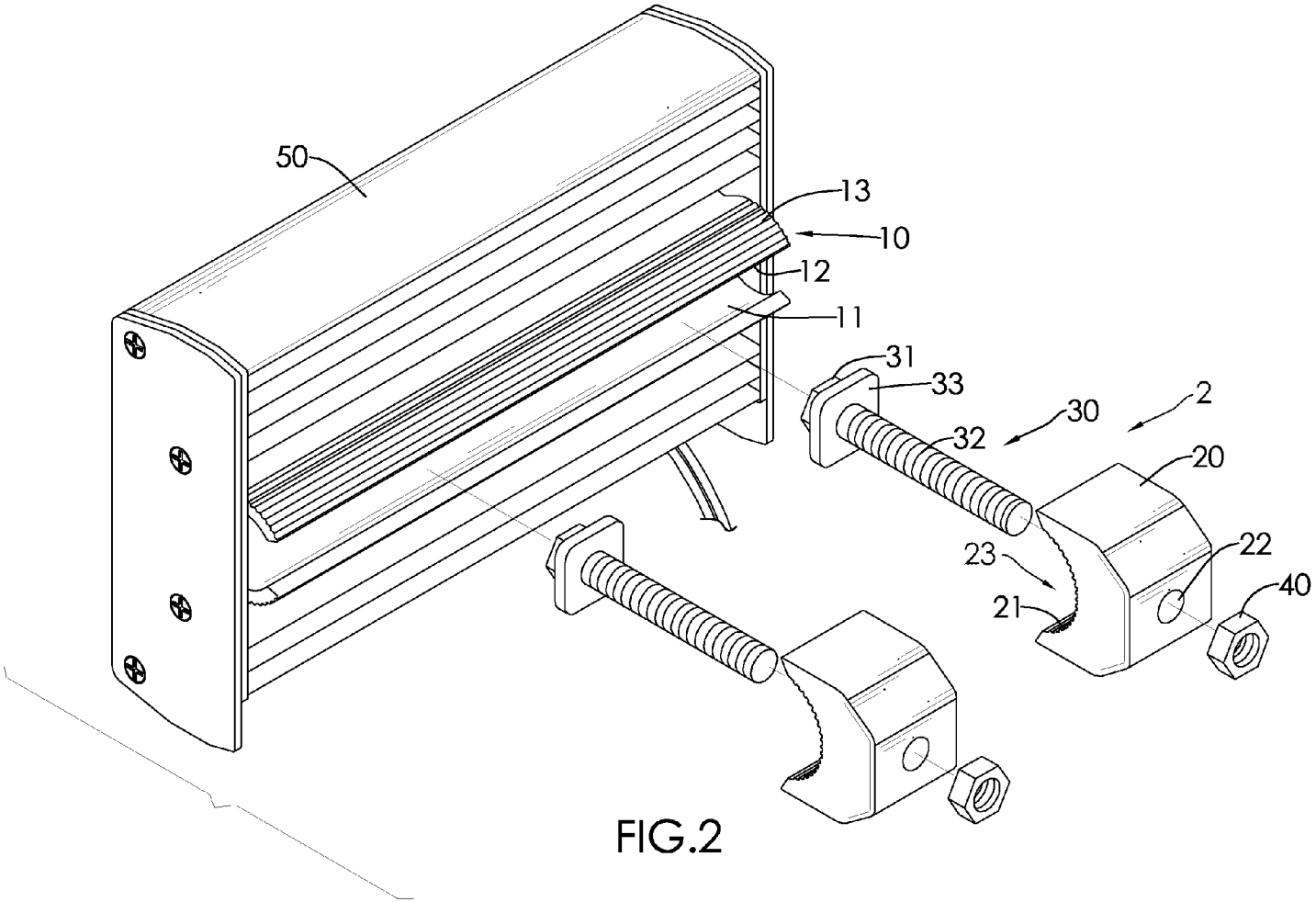
FIG. 2 is an exploded perspective view of the LED lamp with the mounting device in FIG. 1.
Figure 3:
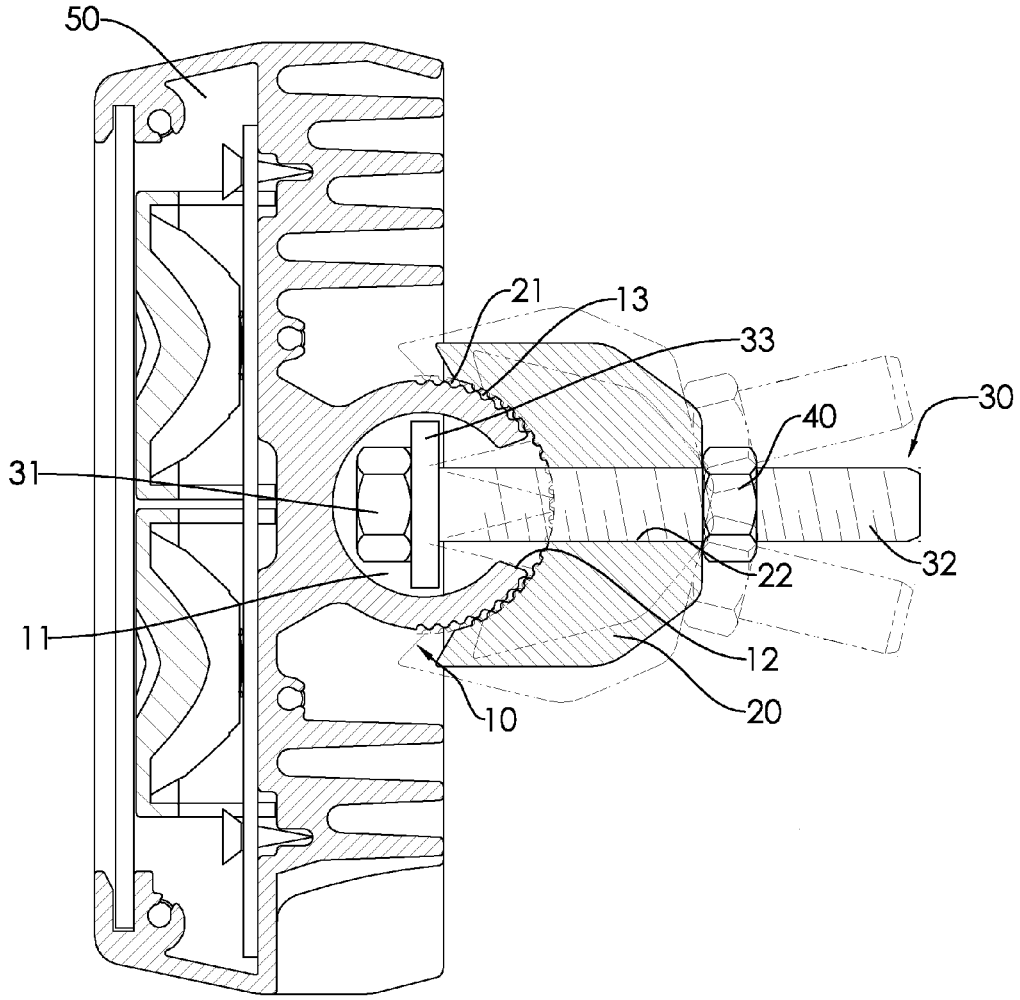
FIG. 3 is an operational side view in partial section of the LED lamp with the mounting device in FIG. 1 showing fixed units being pivoted.

With reference to FIGS. 1 to 3, a mounting device for an LED lamp in accordance with the present invention comprises a support tube 10 and at least one fixed unit 2.

The support tube 10 is formed on and protrudes from a back of an LED lamp 50 laterally and has a tube wall, a chamber 11, a gap 12, an outer surface and an external engaging surface 13. The chamber 11 is defined inside the tube wall of the support tube 10. The gap 12 is formed longitudinally through the tube wall of the support tube 10 and communicates with the chamber 11. The external engaging surface 13 is formed on the outer surface of the support tube 10.

Each one of the at least one fixed unit 2 has a positioning block 20, a positioning bolt 30 and a nut 40. The positioning block 20 is mounted movably and pivotally around the support tube 10 and has a front surface 23, a rear surface, an internal engaging surface 21 and a hole 22. The internal engaging surface 21 is formed on the front surface 23 of the positioning block 20 and engages the external engaging surface 13 of the support tube 10. The hole 22 is formed through the front surface 23 and the rear surface of the positioning block 20.

The positioning bolt 30 is mounted through the hole 22 of the positioning block 20 and has a head 31, a threaded part 32 and a flange 33. The head 31 is mounted in the chamber 11 of the support tube 10. The threaded part 32 is mounted through the gap 12 of the support tube 10 and the hole 22 of the positioning block 20 and protrudes out of the rear surface of the positioning block 20 to mount in an installation location. The flange 33 protrudes radially around the threaded part 32, is adjacent to the head 31 and is mounted in the chamber 11 of the support tube 10. The flange 33 is wider than the gap 12 of the support tube 10 to prevent the positioning bolt 30 and the positioning block 20 from escaping from the support tube 10. The nut 40 is screwed onto the threaded part 32 of the positioning bolt 30 and abuts the rear surface of the positioning block 20. In a preferred embodiment, the mounting device comprises two fixed units 2.

Figure 4:
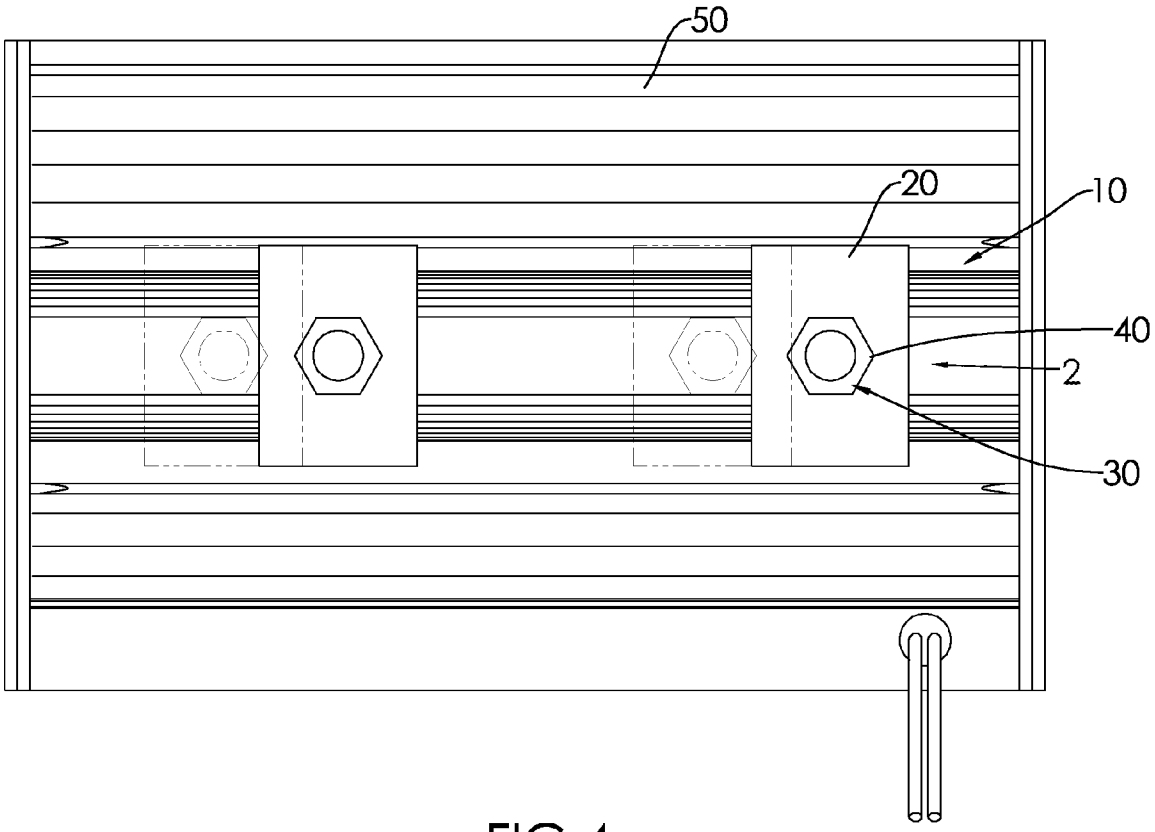
FIG. 4 is an operational rear view of the LED lamp with the mounting device in FIG. 1 showing the fixed units being adjusted in positions.
Figure 5:
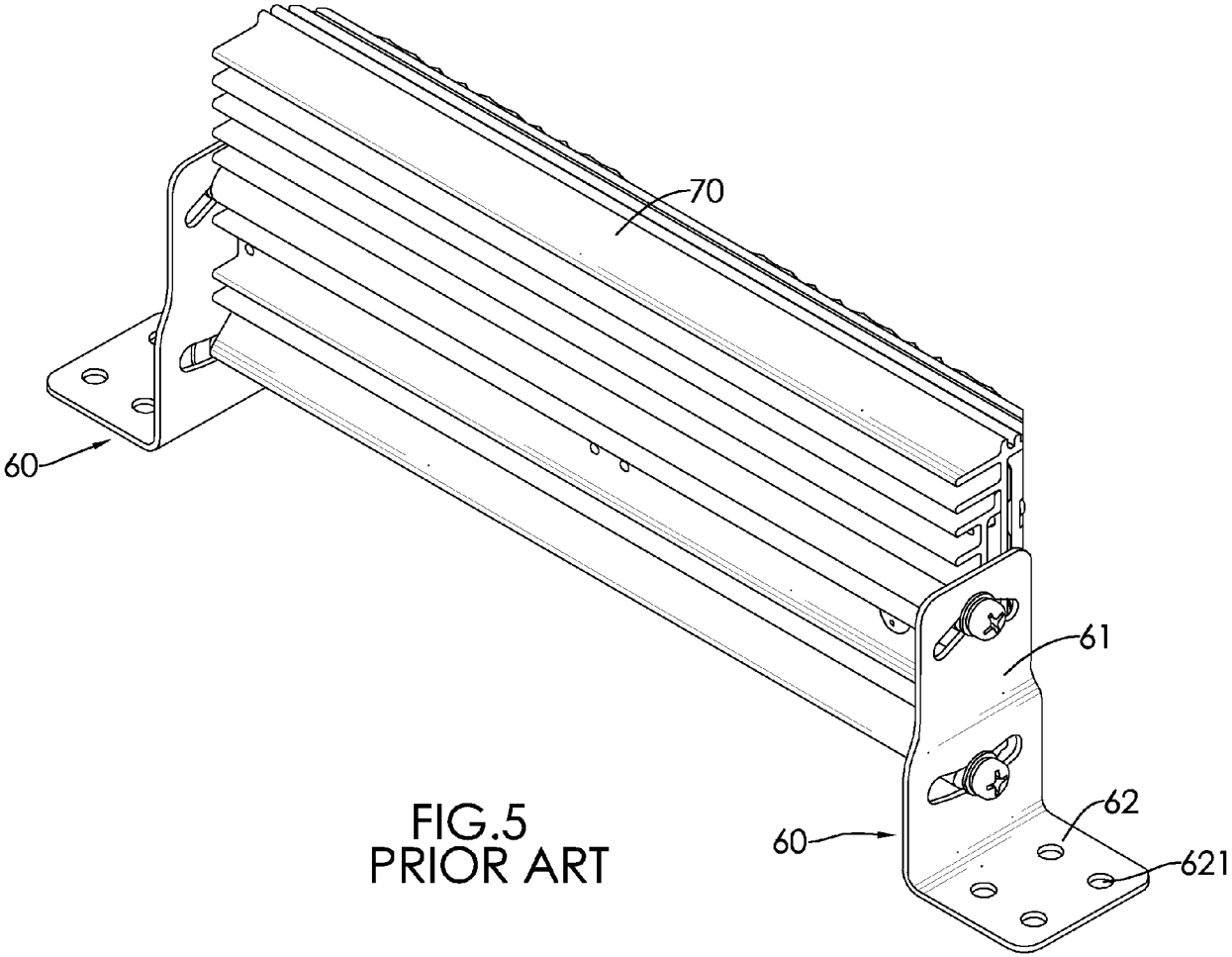
FIG.5 PRIOR ART
FIG. 5 is a perspective view of an LED lamp with a conventional mounting device in accordance with the prior art.

With reference to FIG. 4, when the positioning bolt 30 and the nut 40 are released, the positioning blocks 20 can be moved along the support tube 10, so a distance between the positioning blocks 20 can be adjusted and the LED lamp 50 is applicable to all installation locations. With reference to FIG. 3, the positioning blocks 20 can also be pivoted around the support tube 10 to suitable angles to fit with different needs. After the adjustments of the positioning blocks 20 have been done, the nuts 40 are screwed onto the positioning bolts 30 to make the positioning blocks 20 mounted on the support tube 10 securely. Therefore, the mounting device in accordance with the present invention provides a convenient mechanism for users to adjust suitable positions of the fixed units 2 and the LED lamp 50 can be installed at any location conveniently.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A mounting device for an LED lamp comprising:

a support tube having an outer surface and an external engaging surface formed on the outer surface of the support tube; and at least one fixed unit and each one of the at least one fixed unit having a positioning block mounted movably and pivotally around the support tube, the positioning block having a front surface; and an internal engaging surface formed on the front surface of the positioning block and engaging the external engaging surface of the support tube;

wherein the support tube further has a tube wall;

a chamber defined inside the tube wall of the support tube; and a gap formed through the tube wall of the support tube and communicating with the chamber;

the positioning block of each one of the at least one fixed unit further has a rear surface and a hole formed through the front surface and the rear surface of the positioning block; and each one of the at least one fixed unit further has a positioning bolt mounted through the hole of the positioning block of the fixed unit and having a head mounted in the chamber of the support tube; and a threaded part mounted through the gap of the support tube and the hole of the positioning block and protruding out of the rear surface of the positioning block of the fixed unit; and a nut screwed onto the threaded part of the positioning bolt and abutting the rear surface of the positioning block of the fixed unit.

2. The mounting device for an LED lamp as claimed in claim 1, wherein the positioning bolt of each one of the at least one fixed unit further has a flange protruding around the threaded part adjacent to the head and mounted in the chamber of the support tube and the flange is wider than the gap of the support tube.

3. The mounting device for an LED lamp as claimed in claim 2 comprising two fixed units.

4. The mounting device for an LED lamp as claimed in claim 1 comprising two fixed units.

* * * * *